US005176185A

United States Patent [19]

Rheinganz et al.

[11] Patent Number: 5,176,185

[45] Date of Patent: Jan. 5, 1993

[54] GUIDE TEETH FOR A RAPIER PICKING TAPE

[75] Inventors: Ursula Rheinganz, Laupen; Remo D'Incau, Winterthur, both of Switzerland

[73] Assignee: Sulzer Brothers Limited, Winterthur, Switzerland

[21] Appl. No.: 720,366

[22] Filed: Jun. 25, 1991

[30] Foreign Application Priority Data

Jul. 24, 1990 [CH] Switzerland ..... 2447/90

[51] Int. Cl.[5] ..... D03D 47/27

[52] U.S. Cl. ..... 139/449

[58] Field of Search ..... 139/449

[56] References Cited

U.S. PATENT DOCUMENTS

| | | | |
|---|---|---|---|
| 4,344,466 | 8/1982 | Hasegawa et al. | 139/449 |
| 4,638,839 | 1/1987 | Pezzoli | 139/449 |
| 4,669,513 | 6/1987 | Hintsch | 139/449 X |
| 4,777,989 | 10/1988 | Pezzoli | 139/449 |
| 4,834,146 | 5/1989 | Pezzoli | 139/449 |
| 4,977,932 | 12/1990 | Pezzoli | 139/449 |

FOREIGN PATENT DOCUMENTS

| | | |
|---|---|---|
| 681542 | 10/1966 | Belgium . |
| 0285001 | 10/1988 | European Pat. Off. . |
| 0357974 | 3/1990 | European Pat. Off. . |
| 2643626 | 4/1977 | Fed. Rep. of Germany . |
| 3519685 | 8/1986 | Fed. Rep. of Germany . |
| 48801 | 7/1938 | France . |
| 2270356 | 12/1975 | France . |
| 2552455 | 3/1985 | France . |

*Primary Examiner*—Andrew M. Falik
*Attorney, Agent, or Firm*—Kenyon & Kenyon

[57] ABSTRACT

The rapier loom employs a runner on the underside of a picking tape at the rapier head in order to space the picking tape from the guide teeth used to form a slideway for the rapier within a shed of warp yarns. The runner may have a convex shape while the guide teeth have a curvilinear shape to slidingly support the runner. Alternatively, the runner may have a longitudinal groove to receive the guide teeth. A guide bar may also be disposed outside the shed to form a slideway for the runner while also being spaced from the picking tape.

19 Claims, 3 Drawing Sheets

GUIDE TEETH FOR A RAPIER PICKING TAPE

This invention relates to a rapier loom. More particularly, this invention relates to a rapier loom having guide teeth for a rapier.

As is known, in rapier looms which are widely used nowadays, a weft yarn is picked by means of a giver rapier and a taker rapier into a shed of warp yarns with accurate transfer of the weft yarn from the giver rapier to the taker rapier normally occurring at the center of the shed and being an important consideration.

In order to perform a reliable weft yarn transfer from a giver rapier to a taker rapier, use has been made of guide teeth, particularly in wide looms, in order to guide the rapiers. To this end, the guide teeth have been of various shapes, for example as described in German patent 1279565. However, one disadvantage of the known guide teeth is that the picking tapes which are secured to the rapiers are also guided and, as a result of this guidance, the edges of the tape become damaged by a grazing contact with the teeth. In particular, in the case of fiber-reinforced plastic tapes, the friction between the tapes and the guide teeth leads to the exposure of fibers at the edges of the tape. This, in turn, leads to a surface which has a very abrasive effect. As is known, damaged picking tapes are responsible for many weft yarn breakages.

Further, in high-speed rapier looms, the closing movement of a shed starts while the rapier is actually being drawn out. Hence, the bottom warp yarns come into contact with the edges of the tape, unless the tape is at a distance from the bottom warp yarns, so that the tape suffers detrimental wear with the result of an increase in warp yarn breakages.

Accordingly, it is an object of the invention to mitigate damage to warp yarns in a rapier loom due to contact with a picking tape.

It is another object of the invention to improve the operation of a rapier loom.

It is another object of the invention to reduce the number of warp yarn breakages in a rapier loom due to worn picking tapes.

Briefly, the invention provides a rapier loom which has at least one picking tape for reciprocating into and out of a shed of warp yarns, a rapier head secured to one end of the tape and a plurality of guide teeth which are movable into the shed of warp yarns. In accordance with the invention, a runner is secured to the underside of the picking tape below the rapier head and the guide teeth are shaped to define a slideway for the runner during passage through the shed while, at the same time, being spaced from the picking tape in the vicinity of the runner.

The overall shape and size of the runner as well as the shape of the guide teeth are such that the runner can be easily guided through a shed of warp yarns while the picking tape remains spaced from the guide teeth. This spacing of the picking tape from the guide teeth substantially reduces wear at the edges of the picking tape so that frayed edges are not developed which might otherwise lead to warp yarn breakages.

These and other objects and advantages of the invention will become more apparent from the following detailed description taken in conjunction with the accompanying drawings wherein.

Figure 5A:
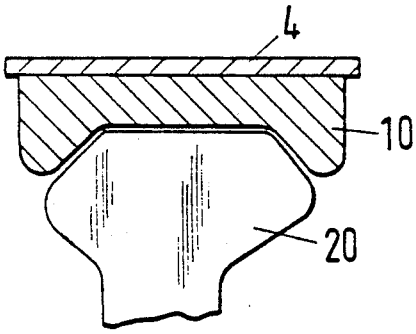
Figure 5B:
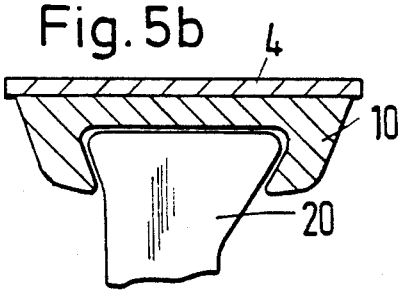
Figure 5C:
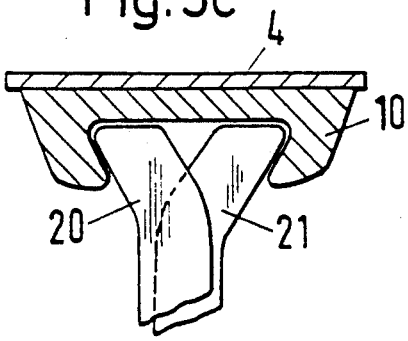
Figure 6:
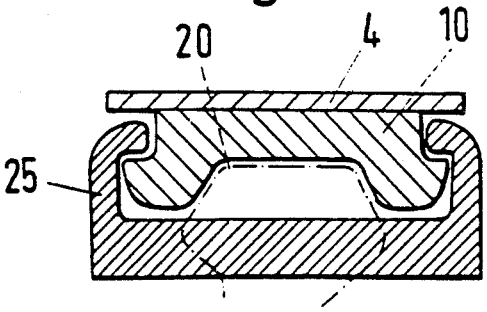

FIG. 5*a* illustrates a view of a modified runner and guide tooth in accordance with the invention;

FIG. 5*b* illustrates a view of a further modified runner and guide tooth in accordance with the invention;

FIG. 5*c* illustrates a view of a modified runner as in FIG. 5*b* with modified guide teeth in accordance with the invention; and FIG. 6 illustrates a cross-sectional view of a guide bar utilized in cooperation with a runner and guide tooth arrangement in accordance with the invention.

Figure 7:
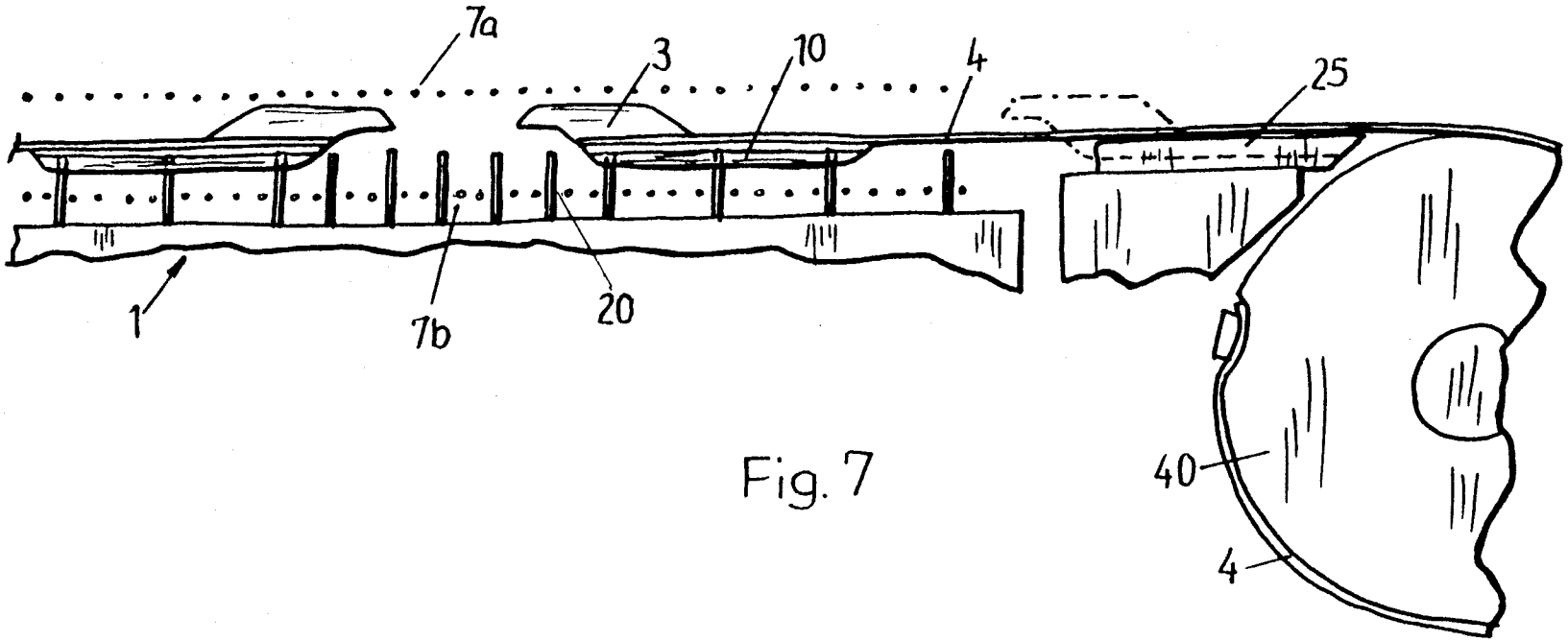

FIG. 7 illustrates a view of a rapier loom including a pair of picking tapes and a modified arrangement of guide teeth.

Figure 1:
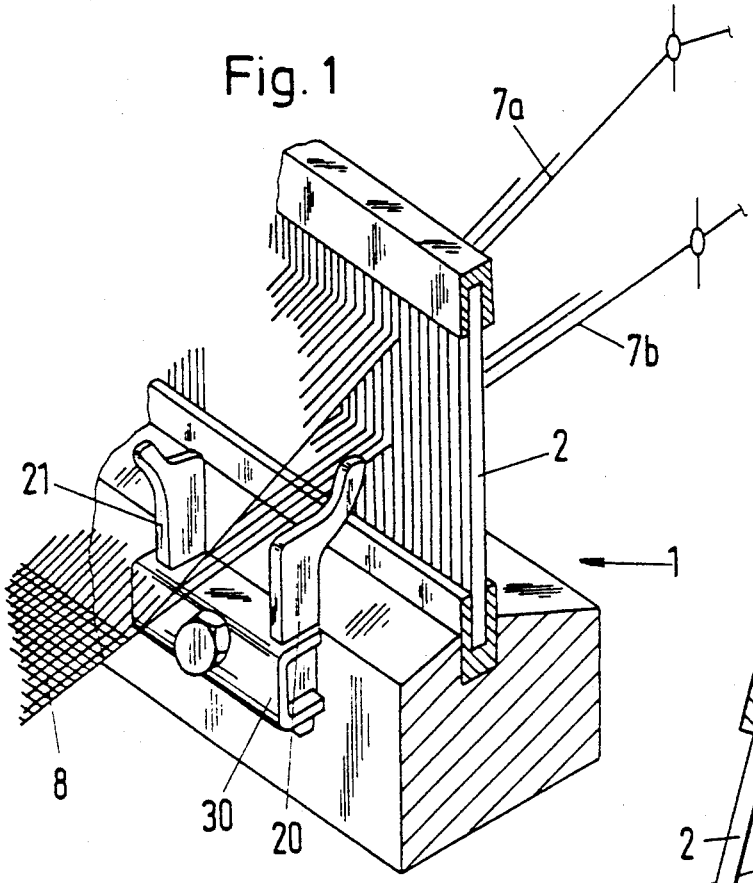
FIG. 1 illustrates a part perspective view of a sley of a rapier loom employing guide teeth in accordance with the invention.

Referring to FIG. 1, the rapier loom is constructed in conventional fashion having a sley 1 on which a reed 2 is mounted and through which a plurality of top warp yarns 7*a* and bottom warp yarns 7*b* pass. As schematically illustrated, suitable means are provided for forming a shed of the warp yarns 7*a*, 7*b*.

Figure 2:
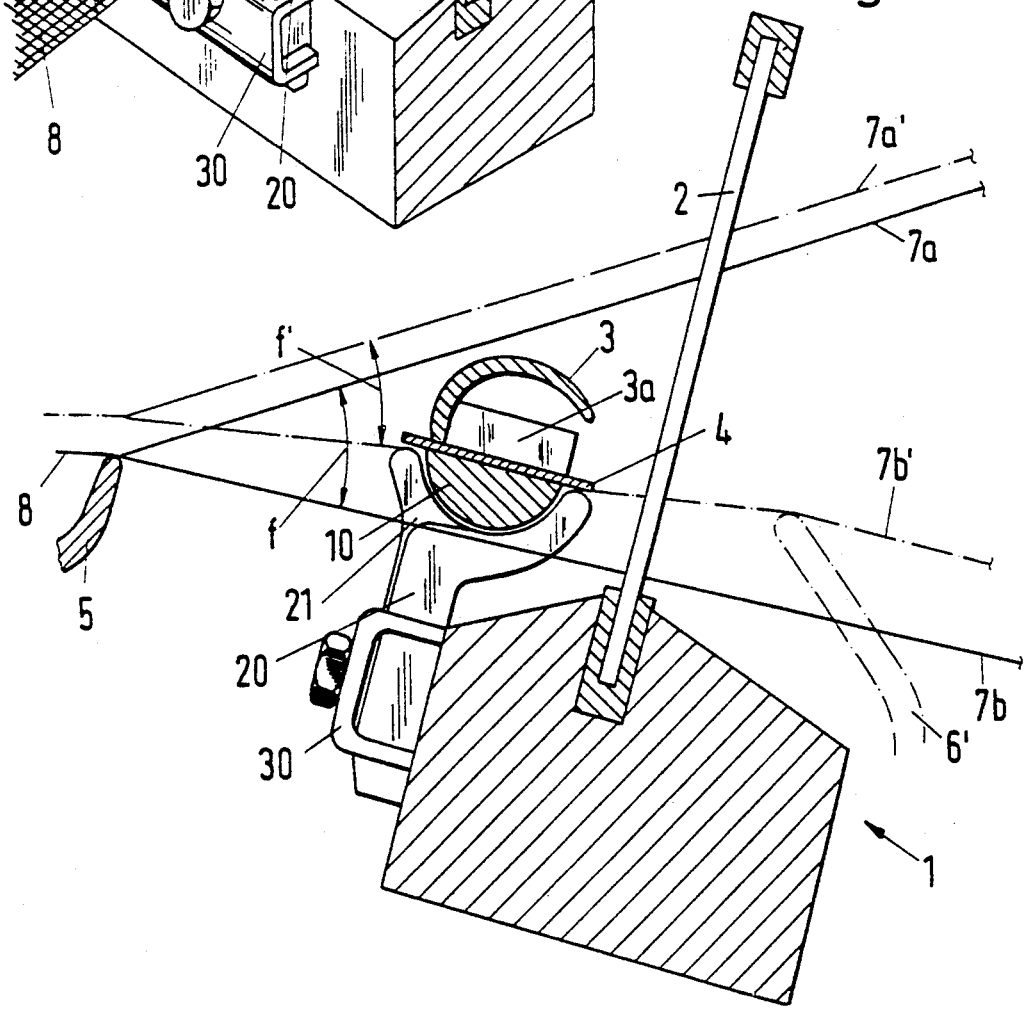
FIG. 2 illustrates a part cross-section of side view of the sley and guide teeth of FIG. 1 relative to a picking tape in accordance with the invention.

Referring to FIG. 2, a giver rapier head 3 which is disposed on top of a picking tape 4 is reciprocated in known manner into and out of the shed of warp yarns 7*a*, 7*b* by suitable means (not shown). As illustrated, the internal components of the rapier head 3, for example, a yarn clamp, are indicated by means of a box 3A. In addition, pairs of guide teeth 20, 21 are secured to the sley 1 by a securing device 30 in order to guide the rapier head 3 within the shed of wrap yarns 7*a*, 7*b*. In this respect, the pairs of guide teeth 20, 21 are provided over the whole width of the sley 1.

The guide teeth can be disposed uniformly at constant distances with the two types of guide teeth, 20, 21, preferably being disposed in an alternating manner. In rapier looms in which a weft yarn is transferred from a giver rapier to a taker rapier, of which may be mounted on a picking tape, the guide teeth may be disposed in a more densely distributed pattern in a central zone of the shed, (see FIG. 7), than in outer zones of the shed because the position of the rapiers requires very accurate monitoring in the central zone of the shed.

Referring to FIG. 2, a runner 10 is secured to the end of the picking tape 4 below the rapier head 3. Further, the guide teeth 20, 21 define a slideway for slidably supporting the runner 10 during travel of the runner 10, tape 4 and rapier head 3 through the shed while being spaced from the picking tape 4 in the vicinity of the runner 10. As illustrated, the runner 10 has a convex cross-section while each guide tooth 20, 21 has a curvilinear surface for slidingly receiving the runner 10. In this respect, one guide tooth 20 of each pair of teeth is disposed to support the runner 10 on one side, i.e. the reed side, while the other guide tooth 21 is disposed to support the runner 10 on the opposite side, i.e. on the side of a cloth support 5 or cloth 8.

Because of the runner 10, the tape 4 is positioned relatively far away from the bottom warp yarns 7*b* and is not disposed immediately above these warp yarns as would be the case in a shed (warp yarns 7*a*', 7*b*' shown in chain-dotted lines) of conventional rapier looms not having guided rapiers. In this respect, the guide teeth 20, 21 make a weft yarn support 6' unnecessary and, thus, enable shed geometry to be improved while allowing the angle f formed by the warp yarns *7a*, *7b* to be greater than the corresponding angle f' in conventional looms.

The spacing of the picking tape 4 from the guide teeth 20, 21 by means of the runner 10 serves to reduce the amount of wear at the edges of the picking tape 4. Further, the runner 10 also serves to space the picking tape 4 from the bottom warp yarns *7b* so that direct contact between the edges of the tape 4 and the warp yarns is mitigated but not completely obviated. However, since roughening of the tape edges by the guide teeth 20, 21 is eliminated, the remaining contacts between the tape 4 and the bottom warp yarns *7b* is considerably reduced. To ensure that the contact between the bottom warp yarns *7b* and the runner 10 causes as little damage as possible, the runner cross-section should be uniformly rounded at the exposed places on the underside.

When the shed opens, the guide teeth 20, 21 pass through the warp yarns *7b* of the bottom shed. To obviate problems occurring such as warp yarn breakages or sticking of the warp yarns, the guide teeth must be appropriately shaped. More particularly, the guide teeth edges which contact the warp yarns 76 must be rounded or bevelled. The guide teeth tops which may graze the flexible sagging picking tape 4 downstream of the runner 10 must be so shaped that the delicate tape edges are not contacted—i.,e., any contact occurring is shifted towards the inside of the tape.

The length of the runner 10 in the tape direction must be other than the length of the rapier head 3. Advantageously, the runner 10 is relatively long so that a number of guide teeth 20, 21 are always in contact with the runner 10. The runner 10 should be as long as possible, viz. so long as permitted by considerations of space between a driving tape wheel (not shown) and the sley 1. A long runner means a welcome stiffening of the tape 4 after the rapier head 3. To prevent excessive weight, as a result of a long runner, the runner can be devised as a hollow member.

Advantageously, the weight of the runner 10 is such that the center of gravity common to the rapier head 3 and runner 10 is disposed below the plane of the tape 4. The low center of gravity ensures that. in contrast to conventional rapier looms, the rapier head 3 does not disengage from the raceway.

The guide teeth 20, 21, which are rubbed continuously by the warp yarns, must be made of a strong material, preferably an abrasion-resistant metal or metal alloy. To ensure that the sliding of the runner 10 on the guide teeth 20, 21 does not cause wear, the runner 10 should be made of a softer material, such as a plastics.

Figure 3:
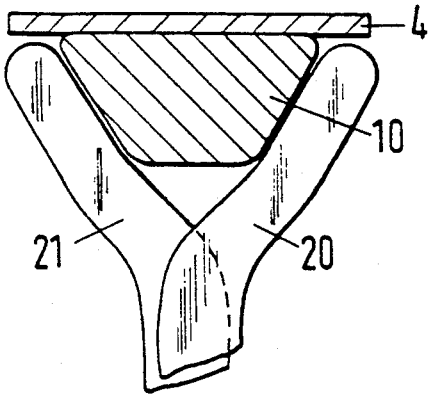
FIG. 3 illustrates a view of a modified arrangement of guide teeth in accordance with the invention.

Referring to FIG. 3, the runner 10 may alternatively be shaped with a trapezoidal shape. As indicated, the corners of the shape are rounded and the sides are flat so as to slide along corresponding mating flat surfaces on the guide teeth 20, 21. In this embodiment, guidance of the runner 10 is provided only on the flanks of the runner 10. Further, the guide teeth 20, 21 are of an elongated shape which ensures a low-resistance penetration into a shed.

Again, as in the above described embodiment, the picking tape 4 is spaced from the ends of the guide teeth 20, 21.

Figure 4:
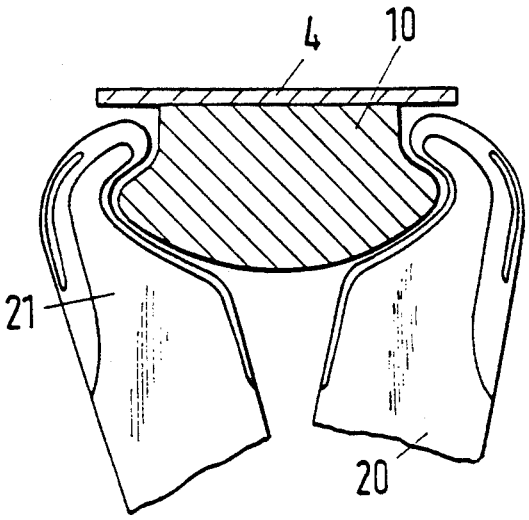
FIG. 4 illustrates a further modified arrangement of guide teeth in accordance with the invention.

Referring to FIG. 4, wherein like reference characters indicate like parts as above, the guide teeth 20, 21 may be crescent-shaped to partially envelop the runner 10 to ensure that the rapier cannot disengage from the slideway defined by the teeth 20, 21 should the center of gravity be disposed above the plane of the tape 4. As illustrated, the runner 10 has a convexly curved lower surface and a rounded rail along each side for fitting within the respective crescent-shaped ends of the guide teeth 20, 21.

Another way of preventing a rapier from disengaging from the slideway defined by the teeth 20, 21 is to place permanent magnets (not shown) in the runner 10. In this case, the guide teeth 20, 21 are made entirely or partly of a ferromagnetic material. This magnetic feature is used with advantage in the embodiment illustrated in FIG. *5a* wherein the runner 10 is provided with a longitudinal groove on the underside while the guide teeth are all the same shape so as to be disposed to support the runner 10. As illustrated, the groove is of channel shape with inclined side flanks while each tooth 20 has a corresponding trapezoidal shape so as to fit within the groove and thus receive the runner 10 in slide relation. In this case, it is a simple matter to arrange for a reduced distance between the magnets and the guide teeth 20 disposed centrally in the runner 10.

Alternatively, as shown in FIG. *5b*, the centrally disposed groove in the underside of a runner 10 may be of dovetail cross-sectional shape with the guide teeth 20 shaped to mate in the groove. Further, as shown in FIG. *5c*, the nonidentical guide teeth 20, 21 can be used with a runner having a dovetail groove. Still further, instead of a trapezoidal cross-section, the groove in the runner 10 may have a rectangular cross-section.

Referring to FIGS. 6 and 7, guides outside the shed can be provided by means of a guide bar 25 which measures several centimeters in length. As indicated, the guide bar 25 is provided with a groove to receive the runner 10 and is longitudinally spaced from the teeth 20 outside the shed for guiding the runner 10 thereon while being spaced from the tape 4. As indicated, guidance in the shed can be provided by teeth 20 of the kind illustrated in FIG. *5a*. Alternatively, in the case of a runner cross-section of the kind shown in FIG. 4, the same shape of slideway can be used for the guide bar 25 and the guide teeth 20, 21.

Of note, it is advantageous to use guide teeth in looms when picking is a one-sided operation using only a giver rapier. In this case, the weft yarn would be transferred outside the shed by means of a stationary device.

The invention thus provides a relatively simple structure for spacing a picking tape from guide teeth within a shed in order to reduce wear on the edges of the tape and, thus, reduce warp yarn breakages.

What is claimed is:

1. A rapier loom comprising at least one picking tape for reciprocating into and out of a shed of warp yarns;

a rapier head secured to one end of said tape;

a runner secured to said end of said tape below said rapier head; and a plurality of guide teeth being movable into the shed of warp yarns to define a slideway for said runner through the shed, said guide teeth being spaced from said picking tape in the vicinity of said runner.

2. A rapier loom as set forth in claim 1 wherein said runner has a convex cross-section.

3. A rapier loom as set forth in claim 1 wherein at least some of said guide teeth are crescent-shaped to impede detachment of said runner therefrom.

4. A rapier loom as set forth in claim 1 wherein some of said guide teeth are disposed to support said runner on one side thereof and others of said guide teeth are disposed to support said runner of an opposite side thereof.

5. A rapier loom as set forth in claim 1 wherein said runner has a longitudinal groove on an underside thereof and said guide teeth are disposed to project into said groove during travel of said runner thereover.

6. A rapier loom as set forth in claim 5 wherein said groove is of dovetail cross-sectional shape and said guide teeth are shaped to mate in said groove.

7. A rapier loom as set forth in claim 1 which further comprises a guide bar longitudinally spaced from said teeth outside the shed for guiding said runner thereon while being spaced from said tape.

8. A rapier loom as set forth in claim 1 which further comprises at least one permanent magnet in said runner and wherein said guide teeth are of ferromagnetic material.

9. A rapier loom as set forth in claim 1 further comprising a pair of said picking tapes, each said tape having a rapier head thereon and a runner secured thereto for sliding on said guide teeth.

10. A rapier loom as set forth in claim 9 wherein said guide teeth are disposed in a more densely distributed pattern in a central zone of the shed than in outer zones of the shed.

11. A rapier loom as set forth in claim 1 wherein said teeth are made of a material more resistant to abrasion than said runner.

12. A rapier loom as set forth in claim 11 wherein said teeth are made of metal and said runner is made of plastic.

13. A rapier loom comprising at least one picking tape for reciprocating into and out of a shed of warp yarns;

a rapier head secured to one end of said tape for movement in the shed;

a runner secured to an underside of said tape below said rapier head, wherein said runner has a convex cross-section; and a plurality of guide teeth being moveable into the shed of warp yarns to define a slideway for slidably supporting said runner thereon during travel of said runner and said rapier head through the shed, wherein said teeth have curvilinear surfaces for slidably receiving said runner.

14. A rapier loom as set forth in 1 which further comprises at least one permanent magnet in said runner and wherein said guide teeth are of ferromagnetic material.

15. A rapier loom as set forth in 1 wherein said runner has a longitudinal groove on an underside thereof and said guide teeth are disposed to project into said groove during travel of said runner thereover.

16. A rapier loom as set forth in claim 13 wherein at least some of said guide teeth are crescent-shaped to partially envelop said runner to impede detachment of said runner therefrom.

17. A rapier loom as set forth in 13 wherein some of said guide teeth are disposed to support said runner on one side thereof and others of said guide teeth are disposed to support said runner of an opposite side thereof.

18. A rapier loom as set forth in 13 which further comprises a guide bar longitudinally spaced from said teeth outside the shed for guiding said runner thereon while being spaced from said tape.

19. A rapier loom as set forth in 18 wherein said bar is crescent-shaped to matingly receive said runner therein, and wherein said runner has a longitudinal groove on an underside thereof and said guide teeth are disposed to project into said groove during travel of said runner thereover.

* * * * *

UNITED STATES PATENT AND TRADEMARK OFFICE

CERTIFICATE OF CORRECTION

PATENT NO. : 5,176,185
DATED : January 5, 1993
INVENTOR(S) : Rheinganz et al.

It is certified that error appears in the above-indentified patent and that said Letters Patent is hereby corrected as shown below:

Column 2, line 27, change "76" to --7b--;
line 45, before "of" insert --each--.

Column 6, lines 14, 18, 26, 30 and 34, after "in" insert --claim--.

Signed and Sealed this

Fourteenth Day of June, 1994

Bruce Lehman

*Attest:*

BRUCE LEHMAN

*Attesting Officer*

*Commissioner of Patents and Trademarks*